US008905786B2

(12) United States Patent
Davis et al.

(10) Patent No.: US 8,905,786 B2
(45) Date of Patent: Dec. 9, 2014

(54) HEADER CONNECTOR FOR AN ELECTRICAL CONNECTOR SYSTEM

(75) Inventors: Wayne Samuel Davis, Harrisburg, PA (US); Robert Neil Whiteman, Jr., Middletown, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 64 days.

(21) Appl. No.: 13/552,209

(22) Filed: Jul. 18, 2012

(65) Prior Publication Data

US 2014/0024256 A1 Jan. 23, 2014

(51) Int. Cl.
*H01R 13/648* (2006.01)

(52) U.S. Cl.
USPC ..... 439/607.1; 439/108

(58) Field of Classification Search
USPC ..... 439/108, 189, 607.06, 607.07, 607.1, 439/607.11, 607.12, 607.35
See application file for complete search history.

(56) References Cited

U.S. PATENT DOCUMENTS

| | | | | |
|---|---|---|---|---|
| 4,824,383 | A | 4/1989 | Lemke | |
| 6,746,278 | B2 * | 6/2004 | Nelson et al. | 439/607.07 |
| 7,775,802 | B2 * | 8/2010 | Defibaugh et al. | 439/65 |
| 8,444,434 | B2 * | 5/2013 | Davis et al. | 439/607.07 |
| 8,449,329 | B1 * | 5/2013 | Schroll | 439/607.05 |
| 8,449,330 | B1 * | 5/2013 | Schroll et al. | 439/607.06 |
| 8,465,323 | B2 * | 6/2013 | Jeon | 439/607.07 |
| 8,475,209 | B1 * | 7/2013 | Whiteman et al. | 439/607.07 |
| 8,535,065 | B2 * | 9/2013 | Costello et al. | 439/65 |
| 8,535,093 | B1 * | 9/2013 | Mason | 439/607.05 |
| 2008/0026640 | A1 | 1/2008 | Zheng et al. | |

FOREIGN PATENT DOCUMENTS

| | | |
|---|---|---|
| EP | 1710873 A | 10/2006 |
| EP | 2194614 A | 6/2010 |

OTHER PUBLICATIONS

International Search Report issued in corresponding PCT Application No. PCT/US2013/049077 on Aug. 29, 2013.

* cited by examiner

*Primary Examiner* — Thanh Tam Le

(57) ABSTRACT

A header connector includes a header housing holding a plurality of header signal contacts and header ground contacts at least partially surrounding corresponding header signal contacts. A ground bracket is coupled to the header housing. The ground bracket is electrically conductive. The ground bracket is electrically connected to each of the header ground contacts to electrically common each of the header ground contacts.

22 Claims, 4 Drawing Sheets

HEADER CONNECTOR FOR AN ELECTRICAL CONNECTOR SYSTEM

BACKGROUND OF THE INVENTION

The subject matter herein relates generally to electrical connector systems.

Some electrical connector systems utilize electrical connectors to interconnect two circuit boards, such as a motherboard and daughtercard. Signal loss and/or signal degradation is a problem in known electrical systems. For example, cross talk results from an electromagnetic coupling of the fields surrounding an active conductor or differential pair of conductors and an adjacent conductor or differential pair of conductors. The strength of the coupling generally depends on the separation between the conductors, thus, cross talk may be significant when the electrical connectors are placed in close proximity to each other. The strength of the coupling also depends on the material separating the conductors. Moreover, as speed and performance demands increase, known electrical connectors are proving to be insufficient. Additionally, there is a desire to increase the density of electrical connectors to increase throughput of the electrical system, without an appreciable increase in size of the electrical connectors, and in some cases, with a decrease in size of the electrical connectors. Such increase in density and/or reduction in size causes further strains on performance.

In order to address performance, some electrical connectors have been developed that utilize shielding between pairs of signal contacts. The shielding is provided in both connectors along the signal lines. Typically, the individual shields are electrically commoned in both circuit boards, however between the circuit boards, the shields remain electrically independent. The signal lines may experience degradation, such as noise, along their lengths through the electrical connectors. The noise may be more problematic at higher frequencies.

A need remains for electrical connectors having improved electrical performance.

BRIEF DESCRIPTION OF THE INVENTION

In one embodiment, a header connector is provided including a header housing holding a plurality of header signal contacts and header ground contacts at least partially surrounding corresponding header signal contacts. A ground bracket is coupled to the header housing. The ground bracket is electrically conductive. The ground bracket is electrically connected to each of the header ground contacts to electrically common each of the header ground contacts.

In another embodiment, a header connector is provided having a header housing holding a plurality of header signal contacts and header ground contacts. The header signal contacts are arranged in pairs. The header ground contacts at least partially surround corresponding pairs of header signal contacts. The header ground contacts are arranged in columns and rows. The header housing has a base wall and the header signal contacts and the header ground contacts extending forward from a front face of the base wall. A ground bracket is coupled to the header housing at the front face. The ground bracket has a plurality of frame pieces positioned between columns of the header ground contacts and a plurality of cross-pieces extending between the frame pieces and positioned between rows of the header ground contacts. The ground bracket is electrically conductive. The ground bracket is electrically connected to each of the header ground contacts to electrically common each of the header ground contacts.

In a further embodiment, an electrical connector system is provided having a receptacle connector and a header connector. The receptacle connector includes a receptacle housing holding a plurality of receptacle signal contacts. The header connector includes a header housing that receives the receptacle connector therein. The header connector holds a plurality of header signal contacts matable with corresponding receptacle signal contacts. The header connector holds a plurality of header ground contacts at least partially surrounding corresponding header signal contacts and receptacle signal contacts when mated. A ground bracket is coupled to the header housing. The ground bracket is electrically conductive. The ground bracket is electrically connected to each of the header ground contacts to electrically common each of the header ground contacts.

DETAILED DESCRIPTION OF THE INVENTION

Figure 1:
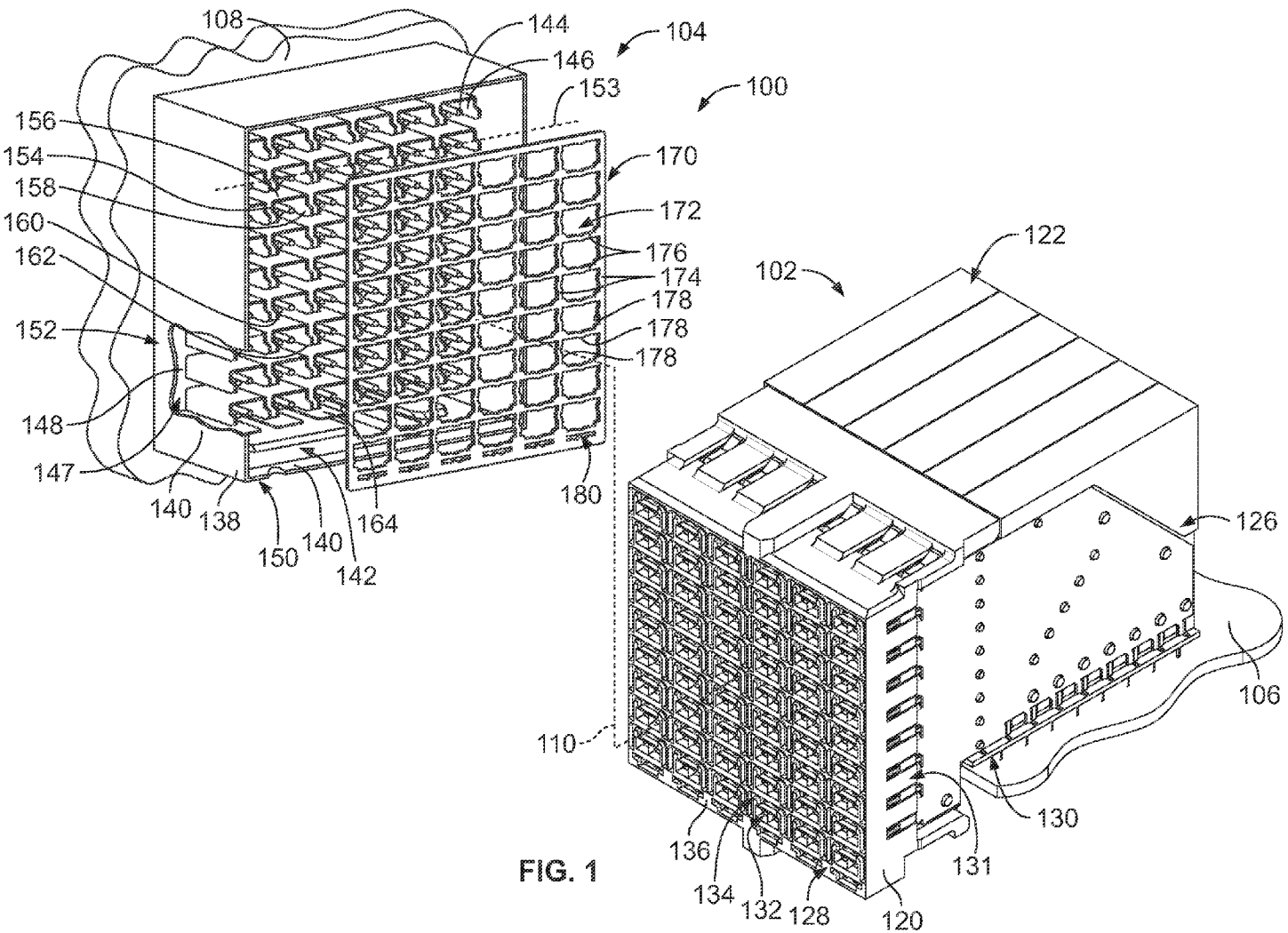
FIG. 1 is a perspective view of an exemplary embodiment of an electrical connector system illustrating a receptacle connector and a header connector.

FIG. 1 is a perspective view of an exemplary embodiment of an electrical connector system 100 illustrating a receptacle connector 102 and a header connector 104 that may be directly mated together. The receptacle connector 102 and/or the header connector 104 may be referred to hereinafter individually as a "connector" or collectively as "connectors". The receptacle and header connectors 102, 104 are electrically connected to respective circuit boards 106, 108. The receptacle and header connectors 102, 104 are utilized to electrically connect the circuit boards 106, 108 to one another at a separable mating interface. In an exemplary embodiment, the circuit boards 106, 108 are oriented perpendicular to one another when the receptacle and header connectors 102, 104 are mated. Alternative orientations of the circuit boards 106, 108 are possible in alternative embodiments. In alternative embodiments, the receptacle and/or header connector 102 and/or 104 may be terminated to one or more cables rather than being board mounted.

A mating axis 110 extends through the receptacle and header connectors 102, 104. The receptacle and header connectors 102, 104 are mated together in a direction parallel to and along the mating axis 110.

The receptacle connector 102 includes a receptacle housing 120 that holds a plurality of contact modules 122. Any number of contact modules 122 may be provided to increase the number of pairs or conductor count of the receptacle connector 102. The contact modules 122 each include a plurality of receptacle signal contacts 124 (shown in FIG. 2) that are received in the receptacle housing 120 for mating with the header connector 104. The receptacle housing 120 holds and positions the receptacle signal contacts 124 for mating with the header connector 104. In an exemplary embodiment, the receptacle signal contacts 124 are arranged in pairs and are configured to convey differential signals. In the illustrated embodiment, the pairs are oriented in row, however the pairs may be arranged in column in alternative embodiments.

In an exemplary embodiment, each contact module 122 of the receptacle connector 102 has a shield structure 126 for providing electrical shielding for the corresponding receptacle signal contacts 124. The shield structure 126 may be defined by separate metal shields and/or by conductive or metalized holders for the receptacle signal contacts 124. In an exemplary embodiment, the shield structure 126 is electrically connected to the circuit board 106, and may be electrically connected to the header connector 104 when the receptacle and header connectors 102, 104 are mated. For example, the shield structure 126 may be electrically connected to the header connector 104 by extensions (e.g. beams or fingers) extending from the contact modules 122 that engage the header connector 104. The shield structure 126 may be electrically connected to the circuit board 106 by features, such as ground pins.

The receptacle connector 102 includes a mating end 128 and a mounting end 130. The receptacle signal contacts 124 are received in the receptacle housing 120 and held therein at the mating end 128 for mating to the header connector 104. The receptacle signal contacts 124 are arranged in a matrix of rows and columns. In the illustrated embodiment, at the mating end 128, the rows are oriented horizontally and the columns are oriented vertically. Other orientations are possible in alternative embodiments. Any number of receptacle signal contacts 124 may be provided in the rows and columns. The receptacle signal contacts 124 also extend to the mounting end 130 for mounting to the circuit board 106. Optionally, the mounting end 130 may be substantially perpendicular to the mating end 128.

The receptacle housing 120 defines the mating end 128 of the receptacle connector 102. The receptacle housing 120 also includes a loading end 131 at a rear of the receptacle housing 120. The contact modules 122 are loaded into the receptacle housing 120 through the loading end 131. In the illustrated embodiment, the contact modules 122 extend beyond (e.g. rearward from) the loading end 131.

The receptacle housing 120 includes a plurality of signal contact openings 132 and a plurality of ground contact openings 134 at the mating end 128. The receptacle signal contacts 124 are received in corresponding signal contact openings 132. Optionally, a single receptacle signal contact 124 is received in each signal contact opening 132. The signal contact openings 132 may also receive corresponding header signal contacts 144 therein when the receptacle and header connectors 102, 104 are mated. The ground contact openings 134 receive header ground contacts 146 therein when the receptacle and header connectors 102, 104 are mated. The ground contact openings 134 receive grounding beams 302 (shown in FIG. 2) of the contact modules 122 that mate with the header ground contacts 146 to electrically common the receptacle and header connectors 102, 104.

The receptacle housing 120 is manufactured from a dielectric material, such as a plastic material, and provides isolation between the signal contact openings 132 and the ground contact openings 134. The receptacle housing 120 isolates the receptacle signal contacts 124 and the header signal contacts 144 from the header ground contacts 146. The receptacle housing 120 isolates each set of receptacle and header signal contacts 124, 144 from other sets of receptacle and header signal contacts 124, 144. The sets may be defined by pairs of the receptacle and header signal contacts 124, 144.

The receptacle housing 120 has a front face 136 at the mating end 128. The front face 136 is generally opposite the loading end 131 at the rear. The front face 136 may be substantially planar. The signal and ground contact openings 132, 134 are open through the front face 136. In an exemplary embodiment, the front face 136 may define the forward-most surface of the receptacle housing 120. Optionally, keying features may extend forward of the front face 136 for keyed mating and/or aligning of the receptacle housing 120 with the header connector 104. In an exemplary embodiment, the mating end 128 of the receptacle housing 120 is plugged into the header connector 104 during mating.

The header connector 104 includes a header housing 138 having walls 140 defining a chamber 142. The walls 140 guide mating of the receptacle connector 102 with the header connector 104. In the illustrated embodiment, the walls 140 are provided at the top, bottom and both sides (one side partially cutaway for clarity) to enclose the chamber 142. In other alternative embodiments, more or fewer walls 140, including no walls 140, may be provided.

The header signal contacts 144 and the header ground contacts 146 are held by the header housing 138. In an exemplary embodiment, the header signal contacts 144 and the header ground contacts 146 extend from a front face 147 of a base wall 148 into the chamber 142. The header signal contacts 144 and the header ground contacts 146 extend through the base wall 148 and are mounted to the circuit board 108. The front face 147 may be substantially planar. The front face 147 defines a back of the chamber 142.

The header connector 104 has a mating end 150 and a mounting end 152 that is mounted to the circuit board 108. The receptacle connector 102 is received in the chamber 142 through the mating end 150. The receptacle housing 120 engages the walls 140 to hold the receptacle connector 102 in the chamber 142. Optionally, the mounting end 152 may be substantially parallel to the mating end 150. Alternatively, the header connector 104 may include contact modules similar to the contact modules 122, which may be held by the header housing 138 and which may define a mounting end that is perpendicular, or at another orientation, to the mating end 150.

In an exemplary embodiment, the header signal contacts 144 are arranged as differential pairs. The differential pairs of header signal contacts 144 are arranged in rows along row axes 153. The header ground contacts 146 are positioned between the differential pairs to provide electrical shielding between adjacent differential pairs. In the illustrated embodiment, the header ground contacts 146 are C-shaped and provide shielding on three sides of the corresponding pair of header signal contacts 144. The header ground contacts 146 have a plurality of walls, such as three planar walls 154, 156, 158. The walls 154, 156, 158 may be integrally formed or alternatively, may be separate pieces. The wall 156 defines a center wall or top wall of the header ground contact 146. The walls 154, 158 define side walls that extend from the center wall 156. The walls 154, 156, 158 have interior surfaces that face the header signal contacts 144 and exterior surfaces that face away from the header signal contacts 144. Other shapes are possible in alternative embodiments.

The header ground contacts 146 have edges 160, 162 at opposite ends of the header ground contacts 146. The edges 160, 162 are downward facing. The edges 160, 162 are provided at the distal ends of the side walls 154, 158, respectively. The bottom is open between the edges 160, 162. The header ground contact 146 associated with another pair of header signal contacts 144 provides the shielding along the open, fourth side thereof such that each of the pairs of signal contacts 144 is shielded from each adjacent pair in the same column and the same row. For example, the top wall 156 of a first header ground contact 146, which is below a second header ground contact 146, provides shielding across the open bottom of the C-shaped second header ground contact 146.

In an exemplary embodiment, the header connector 104 includes orphan header ground contacts 164 below the bottom row of header ground contacts 146. The orphan header ground contacts 164 do not extend around any pairs of header signal contacts 144. The orphan header ground contacts 164 are planar. The orphan header ground contacts 164 provide shielding along the open side of the bottom row of header ground contacts 146.

Other configurations or shapes for the header ground contacts 146 are possible in alternative embodiments. More or less walls may be provided in alternative embodiments. The walls may be bent or angled rather than being planar. In other alternative embodiments, the header ground contacts 146 may provide shielding for individual signal contacts 144 or sets of contacts having more than two signal contacts 144. The spacing or positioning of the header ground contacts 146 and the header signal contacts 144 controls an impedance of the signals.

In an exemplary embodiment, the electrical connector system 100 includes a ground bracket 170 that is received in the header housing 138. The ground bracket 170 is electrically conductive. The ground bracket 170 is configured to be electrically connected to each of the header ground contacts 146, 164. The ground bracket 170 electrically commons each of the header ground contacts 146, 164. The ground bracket 170 is coupled to the header ground contacts 146, 164 by an interference fit for ease of assembly. Alternatively, the ground bracket 170 may be coupled to the header ground contacts 146, 164 by other means.

The ground bracket 170 may affect electrical characteristics of the receptacle and header signal contacts 124, 144, such as by providing shielding along part of the signal lines. Electrically commoning all of the header ground contacts 146, 164 causes the header ground contacts 146, 164 to be at the same electrical potential, which enhances electrical performance of the electrical connector system 100. For example, noise may be reduced along the signal lines by electrically commoning the header ground contacts 146, 164.

The ground bracket 170 includes a plurality of windows 172 surrounded by frame pieces 174 and cross pieces 176 extending between the frame pieces 174. The frame and cross pieces 174, 176 define a lattice-type structure. In the orientation of FIG. 1, the frame pieces 174 extend vertically and the cross pieces 176 extend horizontally. Other configurations or orientations are possible in alternative embodiments. In an exemplary embodiment, the frame and cross pieces 174, 176 are integrally formed. The ground bracket 170 is planar and is stamped from a metal blank to define the windows 172, the frame pieces 174 and the cross pieces 176. Other manufacturing processes may be used in alternative embodiments to form the ground bracket 170.

The windows 172 are sized and shaped to receive the header ground contacts 146 therethrough. In the illustrated embodiment, the windows 172 are generally rectangular shaped, however the windows 172 may have other sizes and shapes in alternative embodiments. The header signal contacts 144 also extend through the windows 172. In an exemplary embodiment, orphan windows 180 are provided, having a different size and shape than the windows 172, for receiving the orphan header ground contacts 164 therethrough.

The ground bracket 170 includes a plurality of interference bumps 178 extending from the frame and cross pieces 174, 176. The interference bumps 178 are configured to engage corresponding header ground contacts 146, 164 by an interference fit. A mechanical and electrical connection is formed by the interference fit. Alternative coupling means may be used in other embodiments to mechanically and/or electrically connect the ground bracket 170 to the header ground contacts 146, 164.

Figure 2:
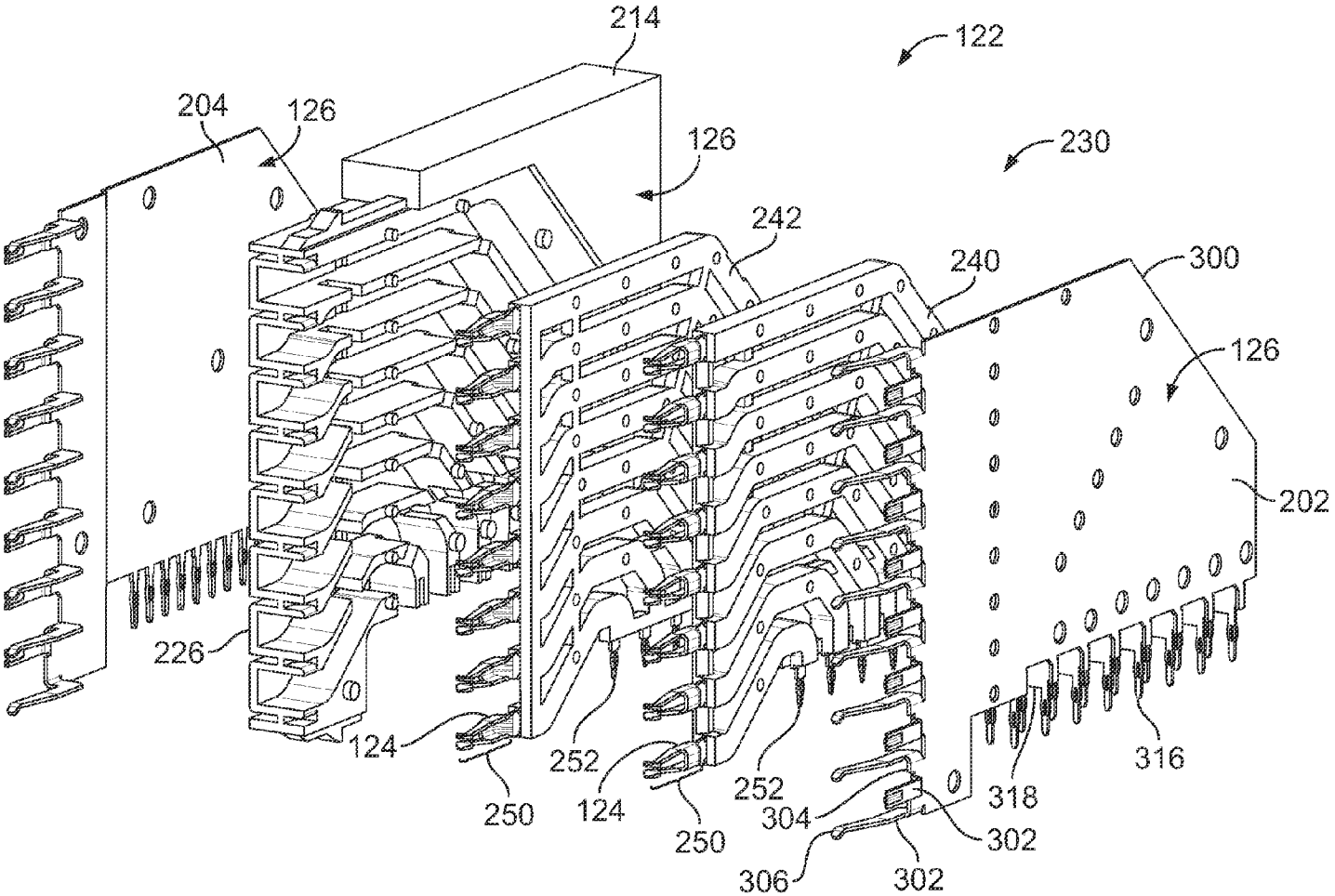
FIG. 2 is an exploded view of a contact module for the receptacle connector.

FIG. 2 is an exploded view of one of the contact modules 122 and part of the shield structure 126. The shield structure 126 includes a first ground shield 202 and a second ground shield 204. The first and the second ground shields 202, 204 electrically connect the contact module 122 to the header ground contacts 146 (shown in FIG. 1). The first and the second ground shields 202, 204 provide multiple, redundant points of contact to the header ground contact 146. For example, the first and the second ground shields may be configured to define at least two points of contact with each C-shaped header ground contact 146 (shown in FIG. 1). The first and the second ground shields 202, 204 provide shielding on all sides of the receptacle signal contacts 124.

The contact module 122 includes a holder 214 fabricated from a conductive material. For example, the holder 214 may be die-cast from a metal material. Alternatively, the holder 214 may be stamped and formed or may be fabricated from a plastic material that has been metalized or coated with a metallic layer. By having the holder 214 fabricated from a conductive material, the holder 214 may provide electrical shielding for the receptacle connector 102. The holder 214 defines at least a portion of the shield structure 126 of the receptacle connector 102. The first and second ground shields 202, 204 are mechanically and electrically coupled to the holder 214. In alternative embodiments, the holder 214 may be a multi-part component, such as being formed by a first holder member and a second holder member that are coupled together to form the holder 214.

The contact module 122 includes a frame assembly 230 held by the holder 214. The frame assembly 230 includes the receptacle signal contacts 124. In an exemplary embodiment, the frame assembly 230 includes a pair of dielectric frames 240, 242 surrounding the receptacle signal contacts 124. The receptacle signal contacts 124 may be initially held together as lead frames (not shown), which are overmolded with dielectric material to form the dielectric frames 240, 242. Other manufacturing processes may be utilized to form the contact modules 122, such as loading receptacle signal contacts 124 into a formed dielectric body.

The receptacle signal contacts 124 have mating portions 250 extending from a front wall of corresponding dielectric frame 240, 242. The receptacle signal contacts 124 have contact tails 252 extending from a bottom wall of the corresponding dielectric frame 240, 242. Other configurations are possible in alternative embodiments. In an exemplary embodiment, the mating portions 250 extend generally perpendicular with respect to the contact tails 252. Alternatively, the mating portions 250 and the contact tails 252 may be at any angle to each other. Inner portions or encased portions of the receptacle signal contacts 124 transition between the mating portions 250 and the contact tails 252 within the dielectric frames 240, 242.

The holder 214 and ground shields 202, 204, which are part of the shield structure 126, provide electrical shielding between and around respective receptacle signal contacts 124. The holder 214 provides shielding from electromagnetic interference (EMI) and/or radio frequency interference (RFI). The holder 214 may provide shielding from other types of interference as well. The holder 214 and ground shields 202, 204 provide shielding around the outside of the dielectric frames 240, 242 and thus around the outside of all of the receptacle signal contacts 124, such as between pairs of receptacle signal contacts 124, to control electrical characteristics, such as impedance control, cross-talk control, and the like, of the receptacle signal contacts 124.

The first and second ground shields 202, 204 are similar to one another, and only the first ground shield 202 is described in detail herein, but the second ground shield 204 includes similar features. The first ground shield 202 includes a main body 300. In the illustrated embodiment, the main body 300 is generally planar.

The first ground shield 202 includes grounding beams 302 extending forward from a front 304 of the main body 300. The grounding beams 302 extend forward from a front 226 of the holder 214 such that the grounding beams 302 may be loaded into the receptacle housing 120 (shown in FIG. 1). Each grounding beam 302 has a mating interface 306 at a distal end thereof. The mating interface 306 is configured to engage the corresponding header ground contact 146.

The first ground shield 202 includes a plurality of ground pins 316 extending from a bottom 318 of the first ground shield 202. The ground pins 316 are configured to be terminated to the circuit board 106 (shown in FIG. 1). The ground pins 316 may be compliant pins, such as eye-of-the-needle pins, that are throughhole mounted to plated vias in the circuit board 106. Other types of termination means or features may be provided in alternative embodiments to couple the first ground shield 202 to the circuit board 106.

Figure 3:
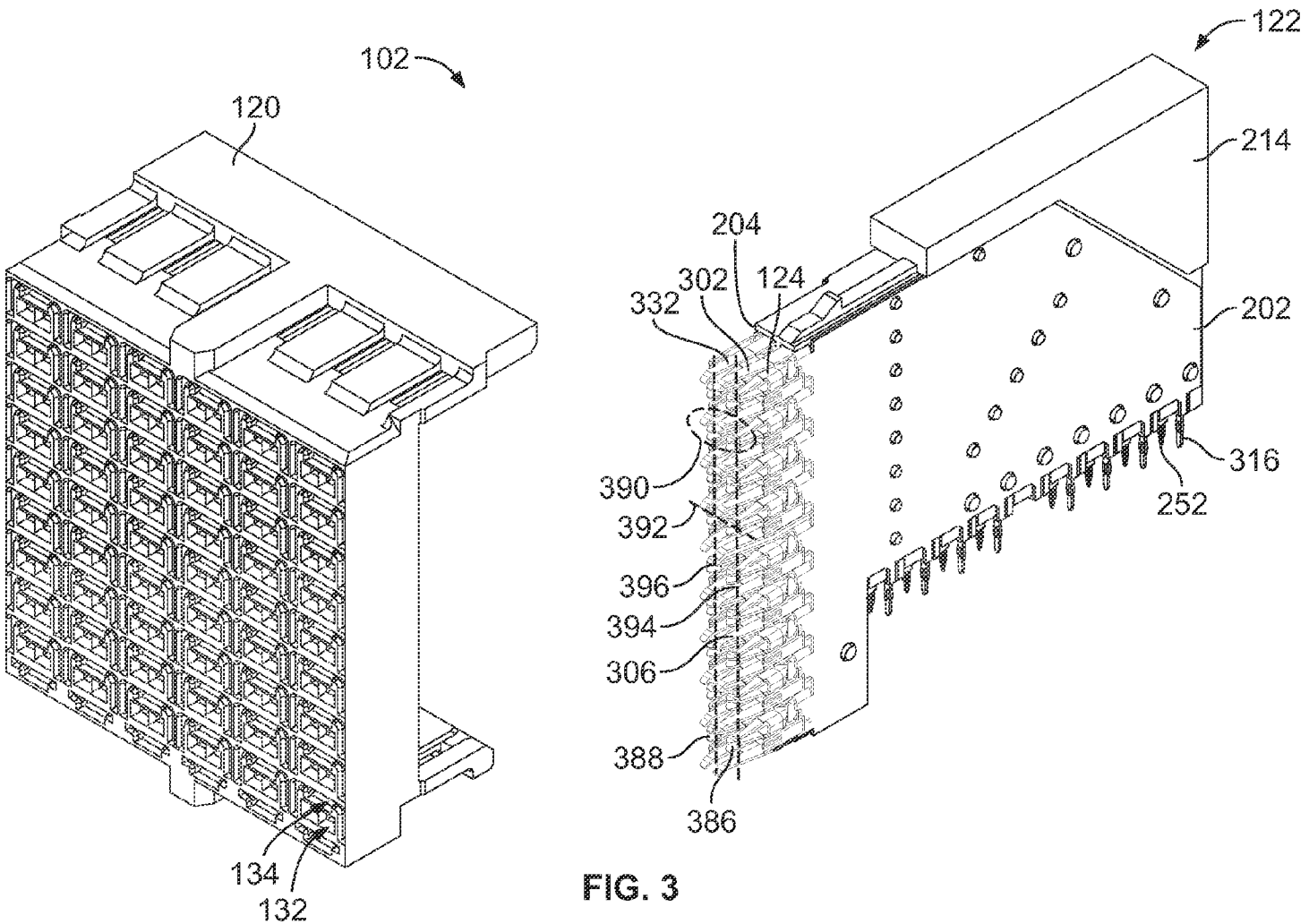
FIG. 3 is an exploded perspective view of the receptacle connector.

FIG. 3 is an exploded perspective view of the receptacle connector 102 showing one of the contact modules 122 in an assembled state poised for loading into the receptacle housing 120. During assembly, the dielectric frames 240, 242 (shown in FIG. 2) are received in the holder 214. The dielectric frames 240, 242 are aligned adjacent one another such that the receptacle signal contacts 124 are aligned with one another and define contact pairs. Each contact pair is configured to transmit differential signals through the contact module 122. The receptacle signal contacts 124 within each contact pair are arranged in rows that extend along row axes. The receptacle signal contacts 124 within the dielectric frame 240 are arranged within a column along a column axis. Similarly, the receptacle signal contacts 124 of the dielectric frame 242 are arranged in a column along a column axis. The receptacle signal contacts 124 are loaded into corresponding signal contact openings 132. The grounding beams 302 are loaded into corresponding ground contact openings 134.

Figure 4:
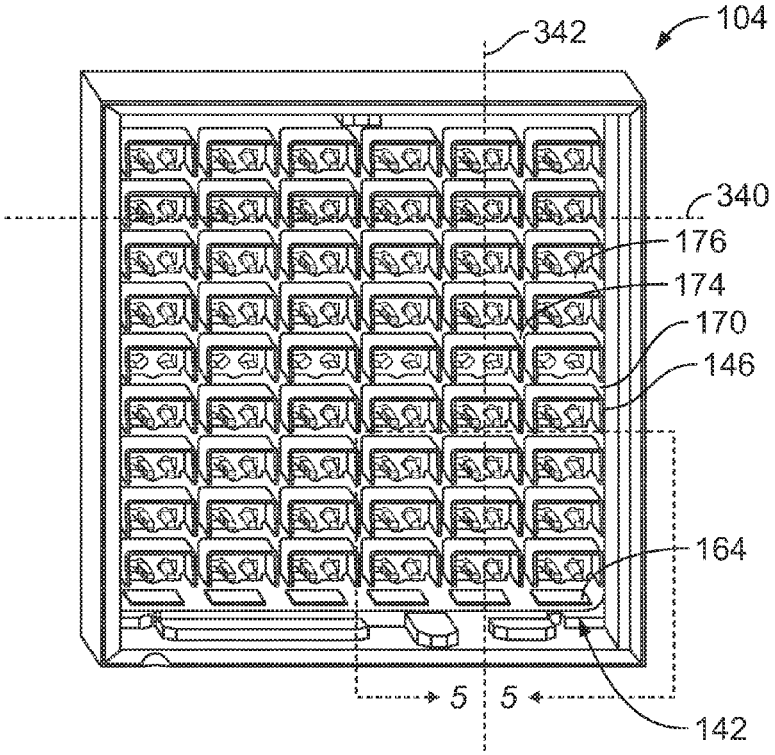
FIG. 4 is a front perspective view of the header connector showing a ground bracket loaded into the header connector.

FIG. 4 is a front perspective view of the header connector 104 showing the ground bracket 170 loaded into the chamber 142. The ground bracket 170 is electrically connected to each of the header ground contacts 146 and the orphan header ground contacts 164. The header ground contacts 146 are arranged in rows 340 and columns 342. In the orientation of FIG. 4, the rows are oriented horizontally and the columns 342 are oriented vertically.

The cross pieces 176 extend between rows 340 of header ground contacts 146. The cross pieces 176 engage header ground contacts 146 both above and below such cross pieces 176. The cross pieces 176 are held by an interference fit between the header ground contacts 146 both above and below such cross pieces 176.

The frame pieces 174 extend between columns 342 of header ground contacts 146. The frame pieces 174 engage header ground contacts 146 on both sides of such frame pieces 174. The frame pieces 174 are held by an interference fit between the header ground contacts 146 on both sides of the frame pieces 174. The frame and/or cross pieces 174 and/or 176 engage the orphan header ground contacts 164.

Figure 5:
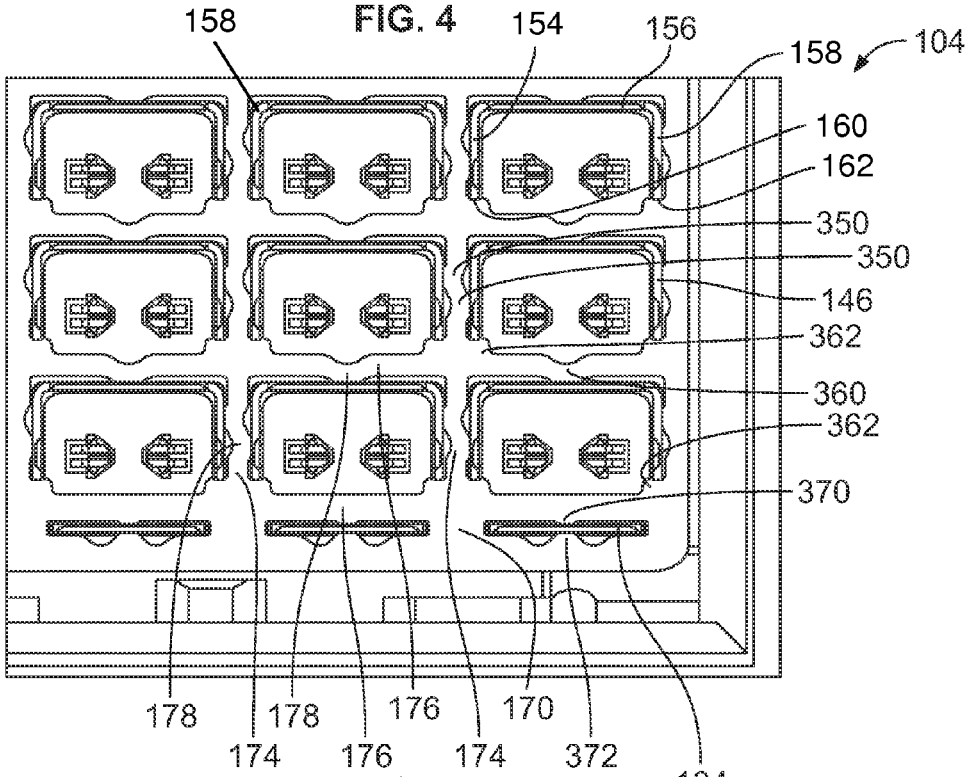
FIG. 5 is an enlarged view of a portion of the header connector and the ground bracket which is bounded by dashed line 5-5 shown in FIG. 4.

FIG. 5 is an enlarged view of a portion of the header connector 104 and the ground bracket 170 which is bounded by dashed line 5-5 shown in FIG. 4. FIG. 5 illustrates the interference bumps 178 engaging the header ground shields 146, 164.

In an exemplary embodiment, the frame pieces 174 each include frame interference bumps 350. Between adjacent cross pieces 176, the frame pieces 174 include a first interference bump 350 extending in one direction (e.g. to the right) to engage the side wall 154 of the adjacent header ground contact 146 and a second interference bump 350 extends in an opposite direction (e.g. to the left) to engage the side wall 158 of the other adjacent header ground contact 146. In an exemplary embodiment, the interference bumps 350 are approximately centered between the adjacent cross pieces 176. Optionally, multiple interference bumps 350 may be provided to engage each adjacent header ground contact 146. Optionally, the first and second interference bumps 350 may transition directly into one another defining S-shaped portions of the frame pieces 174.

The frame pieces 174 may function as springs to bias the interference bumps 350 against the adjacent header ground contacts 146. For example, the first interference bump 350 may press the second interference bump 350 into the corresponding header ground contact 146, and the second interference bump 350 likewise may press the first interference bump 350 into the corresponding header ground contact 146.

In an exemplary embodiment, the cross pieces 176 each include cross interference bumps 360. Between adjacent frame pieces 174, the cross pieces 176 include a first interference bump 360 extending in one direction (e.g. downward) to engage the center wall 156 of an adjacent header ground contact 146 (e.g. below the cross piece 176). In an exemplary embodiment, the first interference bump 360 is approximately centered between the adjacent frame pieces 174. Optionally, multiple interference bumps 360 may be provided to engage the header ground contact 146 below such cross piece 176.

The cross pieces 176 include edge interference bumps 362 configured to engage the edges 160, 162 of the side walls 154, 158 of the header ground contacts 146 above the cross pieces 176. Optionally, the edge interference bumps 362 may be positioned in the corners where the cross pieces 176 intersect with the frame pieces 174. The edge interference bumps 362 extend upward to engage the opposite edges 160, 162 of the adjacent header ground contact 146.

The cross pieces 176 may function as springs to bias the interference bumps 360, 362 against the header ground contacts 146. For example, the first interference bump 360 may press the edge interference bumps 362 into the edges 160, 162 to ensure that the cross pieces 176 maintain physical contact with the header ground contacts 146 above the cross pieces 176.

In an exemplary embodiment, the cross pieces 176 above and below the orphan header ground contacts 164 include orphan interference bumps 370, 372 that engage the top and bottom surfaces of the orphan header ground contacts 164. The frame pieces 174 may include orphan interference bumps that engage sides of the orphan header ground contacts 164.

When the ground bracket 170 is coupled to the header connector 104, the ground bracket 170 is electrically connected to each of the header ground contacts 146, 164. The ground bracket 170 has multiple points of contact with each header ground contact 146, 164. For example, the ground bracket 170 touches each header ground contact 146 along the center wall 156, along the side wall 154, along the side wall 158, at the edge 160 and at the edge 162. Electrically commoning each of the header ground contacts 146, 164 remote from the circuit boards 106, 108 (both shown in FIG. 1) may reduce noise along the signal lines. Electrically commoning the header ground contacts 146, 164 may electrically common each of the contact modules 122 (shown in FIG. 2), which may provide better shielding along the signal lines through the receptacle connector 102 (shown in FIG. 1).

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

What is claimed is:

1. A header connector comprising:

a header housing holding a plurality of header signal contacts and header ground contacts, the header signal contacts being arranged in pairs and with the header signal contacts being arranged in a plurality of rows and a plurality of columns, the header ground contacts at least partially surrounding corresponding pairs of header signal contacts; and a ground bracket separately provided from the header housing and from the header ground contacts, the ground bracket being coupled to the header housing and the header ground contacts after the plurality of header signal contacts and header ground contacts are arranged in the header housing, the ground bracket being electrically conductive, the ground bracket being electrically connected to each of the header ground contacts to electrically common each of the header ground contacts.

2. The header connector of claim 1, wherein the ground bracket includes interference bumps engaging corresponding header ground contacts by an interference fit.

3. The header connector of claim 1, wherein the ground bracket includes windows surrounded by frame pieces and cross pieces, the header signal contacts and header ground contacts extending through corresponding windows, the frame pieces and cross pieces engaging corresponding header ground contacts.

4. The header connector of claim 1, wherein the header ground contacts are C-shaped having a center wall and opposite side walls, the ground bracket engaging the center wall and both side walls of each header ground contact.

5. The header connector of claim 1, wherein the header ground contacts are C-shaped having a center wall and opposite side walls extending to opposite edges, the header ground contacts being open between the edges, the ground bracket having cross pieces extending between adjacent header ground contacts, the cross pieces engaging the center wall of one header ground contact and both edges of the adjacent header ground contact.

6. The header connector of claim 1, wherein the header ground contacts are C-shaped having a center wall and opposite side walls, the ground bracket having frame pieces extending between adjacent header ground contacts, each frame piece engaging a side wall of one header ground contact and a side wall of the adjacent header ground contact.

7. The header connector of claim 1, wherein the ground bracket is planar and stamped from a metal blank.

8. The header connector of claim 1, wherein the header housing includes a base wall, the header signal contacts and header ground contacts extending forward from a front face of the base wall, the ground bracket abutting against the front face of the base wall.

9. The header connector of claim 1, wherein the ground bracket is engaged in physical contact with at least some of the header ground contacts to electrically connect the ground bracket to each of the header ground contacts.

10. The header connector of claim 1, wherein the header ground contacts are configured to mate with corresponding receptacle ground contacts that are held by a receptacle housing of a receptacle connector that is configured to mate with the header connector.

11. A header connector comprising:

a header housing holding a plurality of header signal contacts and header ground contacts, the header signal contacts being arranged in pairs, the header ground contacts at least partially surrounding corresponding pairs of header signal contacts, the header ground contacts being arranged in columns and rows, the header housing having a base wall, the header signal contacts and the header ground contacts extending forward from a front face of the base wall; and a ground bracket coupled to the header housing at the front face, the ground bracket having a plurality of frame pieces positioned between columns of the header ground contacts, the ground bracket having a plurality of cross pieces extending between the frame pieces and positioned between rows of the header ground contacts, the ground bracket being electrically conductive, the ground bracket being electrically connected to each of the header ground contacts to electrically common each of the header ground contacts.

12. The header connector of claim 11, wherein the ground bracket includes interference bumps engaging corresponding header ground contacts by an interference fit.

13. The header connector of claim 11, wherein the ground bracket includes windows surrounded by corresponding frame pieces and cross pieces, the header signal contacts and header ground contacts extending through corresponding windows, the frame pieces and cross pieces engaging corresponding header ground contacts.

14. The header connector of claim 11, wherein the header ground contacts are C-shaped having a center wall and opposite side walls, the frame pieces engaging corresponding side walls and the cross pieces engaging corresponding center walls of the header ground contacts.

15. The header connector of claim 11, wherein the header ground contacts are C-shaped having a center wall and opposite side walls extending to opposite edges, the header ground contacts being open between the edges, the cross pieces engaging the center wall of one header ground contact and both edges of the adjacent header ground contact.

16. The header connector of claim 11, wherein the header ground contacts are C-shaped having a center wall and opposite side walls, each frame piece engaging a side wall of one header ground contact and a side wall of the adjacent header ground contact.

17. The header connector of claim 11, wherein the ground bracket is engaged in physical contact with at least some of the header ground contacts to electrically connect the ground bracket to each of the header ground contacts.

18. An electrical connector system comprising:

a receptacle connector comprising a receptacle housing holding a plurality of receptacle signal contacts, the receptacle housing having a front face; and a header connector comprising a header housing receiving the receptacle connector therein, the header connector holding a plurality of header signal contacts arranged in pairs and matable with corresponding receptacle signal contacts and being arranged in a plurality of rows and a plurality of columns, the header connector holding a plurality of header ground contacts at least partially surrounding corresponding pairs of header signal contacts and receptacle signal contacts; and a ground bracket separately provided from the header housing and from the header ground contacts, the ground bracket being coupled to the header housing and the header ground contacts after the plurality of header signal contacts and header ground contacts are arranged in the header housing, the ground bracket being electrically conductive, the ground bracket being electrically connected to each of the header ground contacts to electrically common each of the header ground contacts.

19. The electrical connector system of claim 18, wherein the ground bracket includes interference bumps engaging corresponding header ground contacts by an interference fit.

20. The electrical connector system of claim 18, wherein the header ground contacts are C-shaped having a center wall and opposite side walls, the ground bracket engaging the center wall and both side walls of each header ground contact.

21. The electrical connector system of claim 18, wherein the header signal contacts are arranged in pairs, the ground bracket being positioned between each pair of header signal contacts.

22. The electrical connector system of claim 18, wherein the ground bracket is engaged in physical contact with at least some of the header ground contacts to electrically connect the ground bracket to each of the header ground contacts.

* * * * *